United States Patent [19]

Praba et al.

[11] Patent Number: 4,679,011

[45] Date of Patent: Jul. 7, 1987

[54] WAVEGUIDE DIRECTIONAL COUPLER FAMILY WITH A COMMON HOUSING HAVING DIFFERENT SETS OF CONDUCTIVE BLOCK INSERTABLE THEREIN

[75] Inventors: Krishna Praba; Charles E. Profera, Jr., both of Camden County, N.J.

[73] Assignee: RCA Corporation, Princeton, N.J.

[21] Appl. No.: 842,773

[22] Filed: Mar. 21, 1986

[51] Int. Cl.[4] ..... H01P 5/18

[52] U.S. Cl. ..... 333/111; 333/113

[58] Field of Search ..... 333/109–111, 333/113, 114, 248

[56] References Cited

U.S. PATENT DOCUMENTS

| | | | |
|---|---|---|---|
| 2,558,385 | 6/1951 | Purcell | 333/113 |
| 2,574,790 | 11/1951 | King, Jr. | 333/22 R X |
| 3,044,026 | 7/1962 | Patterson | 333/113 |
| 3,092,790 | 6/1963 | Leake et al. | 333/110 |
| 3,234,555 | 2/1966 | Petrilla et al. | 333/110 X |
| 3,727,152 | 4/1973 | Bodonyi | 333/135 |
| 3,963,998 | 6/1976 | Richter | 333/113 X |
| 3,999,151 | 12/1976 | Baldwin et al. | 333/114 |
| 4,571,545 | 2/1986 | Griffin et al. | 333/109 X |

FOREIGN PATENT DOCUMENTS

| | | | |
|---|---|---|---|
| 0094505 | 5/1985 | Japan | 333/113 |

*Primary Examiner*—Eugene R. LaRoche
*Assistant Examiner*—Benny T. Lee
*Attorney, Agent, or Firm*—Clement A. Berard, Jr.; Robert L. Troike; William H. Meise

[57] ABSTRACT

A family of waveguide branch directional couplers having various coupling values is adapted for using the same housing dimensions for all members of the family. The housing includes a conductive block defining first and second spaced-apart parallel rectangular through waveguides. The block also defines a chamber extending between the through waveguides. One or more further conductive blocks in the form of rectangular parallelepipeds are fastened within the chamber and dimensioned to coact with the chamber dimensions to define at least two rectangular branch waveguides extending between the through waveguides. The dimensions of the further blocks are selected to adjust the branch waveguide dimensions to provide the various coupling values.

2 Claims, 16 Drawing Figures

| COUPLING FACTOR (dB) | I<br>BRANCH 332, 342 HEIGHT $H_3$ mils (mm) | II<br>BRANCH 352 HEIGHT $H_4$ mils (mm) | III<br>BLOCK DIMENSION $L_1$ mils (mm) | IV<br>CENTER-TO-CENTER SPACING $S_2$ mils (mm)(λ) | V<br>TOTAL LENGTH $2X(H_3+L_1)+H_4$ mils (mm)(λ) |
|---|---|---|---|---|---|
| -6.00 | 55.4 (1.40) | 105.5 (2.67) | 233.75 (5.93) | 314.2 (7.98) [0.239] | 683.8 (17.36) [0.52] |
| -8.99 | 37.6 (0.955) | 73.8 (1.87) | 267.4 (6.79) | 323.1 (8.20) [0.246] | 683.8 (17.36) [0.52] |
| -11.0 | 29.3 (0.744) | 58.3 (1.48) | 283.5 (7.20) | 327.3 (8.31) [0.249] | 683.8 (17.36) [0.52] |
| -13.01 | 23.0 (0.584) | 46.0 (1.16) | 295.9 (7.51) | 330.4 (8.39) [0.251] | 683.8 (17.36) [0.52] |

3-BRANCH DIRECTIONAL COUPLER THROUGH WAVEGUIDE HEIGHT $H_1$ = 0.200", BRANCH LENGTH $L_2$ = 0.2769"

*Fig. 3c*

| COUPLING FACTOR (dB) | PORT 1 TO 2 THROUGH LOSS (dB) | BRANCH HEIGHT $H_3$ mils (mm) | BRANCH HEIGHT $H_4$ mils (mm) | BLOCK DIMENSION $L_1$ mils (mm) | BLOCK DIMENSION $L_3$ mils (mm) | BRANCH SPACING $S_3$-$S_4$ mils (mm) | TOTAL CHAMBER LENGTH $H_3+3(S_3)$ IN (mm) [λ] |
|---|---|---|---|---|---|---|---|
| -1.01 | -6.86 | 69.5 (1.76) | 159.0 (4.03) | 210.75 (5.35) | 166.0 (4.21) | 325 (8.25) | 1.0445 (26.53) [0.796] |
| -2.00 | -4.33 | 57.0 (1.44) | 133.5 (3.39) | 233.75 (5.93) | 195.5 (4.96) | 329 (8.35) | 1.0445 (26.53) [0.796] |
| -3.01 | -3.01 | 48.5 (1.23) | 114.5 (2.90) | 250.5 (6.36) | 217.5 (5.52) | 332 (8.43) | 1.0445 (26.53) [0.796] |
| -4.02 | -2.19 | 42.0 (1.06) | 99.0 (2.51) | 263.5 (6.69) | 235.0 (5.96) | 334 (8.48) | 1.0440 (26.51) [0.795] |
| -5.02 | -1.64 | 36.0 (0.914) | 87.0 (2.20) | 274.5 (6.97) | 249.0 (6.32) | 336 (8.53) | 1.0440 (26.51) [0.795] |
| -6.02 | -1.25 | 31.5 (0.800) | 76.5 (1.94) | 284.0 (7.21) | 261.5 (6.64) | 338 (8.58) | 1.0455 (26.55) [0.797] |
| -7.02 | -0.96 | 27.5 (0.698) | 67.5 (1.71) | 291.5 (7.40) | 271.5 (6.89) | 339 (8.61) | 1.0445 (26.53) [0.796] |
| -8.01 | -0.75 | 24.5 (0.622) | 59.5 (1.51) | 298.0 (7.56) | 280.5 (7.12) | 340 (8.63) | 1.0445 (26.53) [0.796] |
| -9.03 | -0.58 | 21.5 (0.546) | 52.5 (1.33) | 304.0 (7.72) | 288.5 (7.32) | 341 (8.66) | 1.0445 (26.53) [0.796] |
| -10.03 | -0.45 | 19.0 (0.482) | 46.5 (1.18) | 309.25 (7.85) | 295.5 (7.50) | 342 (8.68) | 1.0450 (26.54) [0.796] |

4-BRANCH DIRECTIONAL COUPLER THROUGH WAVEGUIDE HEIGHT $H_1$ = 0.200", BRANCH LENGTH $L_2$ = 0.278"

*Fig. 6b*

WAVEGUIDE DIRECTIONAL COUPLER FAMILY WITH A COMMON HOUSING HAVING DIFFERENT SETS OF CONDUCTIVE BLOCK INSERTABLE THEREIN

This invention relates to waveguide directional couplers of the branch waveguide type in which a common housing may be used for various degrees of coupling and in which replaceable blocks define the dimensions of the branch waveguides and therefore the amount of coupling.

BACKGROUND OF THE INVENTION

Waveguide directional couplers are widely used in applications such as the combining of power from a plurality of low power signal sources to generate higher power signals, for signal sampling, for comparing the power applied to and reflected from an antenna, in noncontact phase shifting switching schemes, and the like.

In general, a waveguide branch directional coupler includes two generally parallel through waveguides which are connected together by two or more branch waveguides, as described in U.S. Pat. No. 2,558,385 issued June 26, 1951, to Purcell. The relative amount of power coupled from one of the through waveguides to the other is determined by the amount of power flowing in the branch waveguides, which, in turn, depends upon the relative dimensions of the branch waveguide and the through waveguide to which the signal is applied. The directional properties arise from spacings of the branch waveguides at multiples of one-quarter wavelength, which results in in-phase addition at a given port for one direction of propagation and out-of-phase addition (cancellation) at the other port. The couplers are often manufactured by machining slots into a solid block of metal to form a conductive housing. A separate cover closes the housing. In the past, the design and fabrication of waveguide branch couplers has been difficult because the cross-sectional dimensions of the branch waveguides differed from one coupling value to another, and in addition the center-to-center spacing between the branch waveguides remained at one-quarter wavelength ($\lambda/4$) at the center of the operating frequency range. Consequently, a change in coupling value which necessitates a change in the cross-sectional dimensions of the branch waveguide may also affect the center-to-center spacing between adjacent branch waveguides. Further, the change in center-to-center spacing affects the overall dimensions of the directional coupler, so that the overall dimensions of the required housing might differ from coupler to coupler. Since the exact value of coupling depends upon slight junction effects which are not readily calculable, a branch waveguide directional coupler calculated to give a desired value might, when actually manufactured, deviate slightly from the desired coupling value. In order to obtain a directional coupler having the desired coupling value, it would then be necessary to fabricate a new coupler housing having different branch waveguide cross-sectional dimensions, center-to-center spacing and overall dimensions. This procedure is time consuming and expensive.

It is desirable to have a branch directional coupler which can be inexpensively made for various different coupling values.

SUMMARY OF THE INVENTION

A waveguide branch directional coupler includes a conductive housing which defines first and second mutually parallel waveguides and a chamber which extends therebetween. The width of the chamber is equal to the width of the waveguides. The length of the chamber in a direction parallel to the axes of the waveguides is fixed for all members of a family of coupling values. Consequently, a common housing size may be used for a variety of coupling values. The coupler includes one or more rectangular conductive blocks dimensioned to extend between the waveguides. The conductive blocks are so dimensioned that when fastened in place within the chamber they define two or more branch waveguides extending between the parallel waveguides. The sizes of the blocks are selected to provide the desired coupling value.

DESCRIPTION OF THE DRAWING

FIG. 6*b* tabulates dimensions of the coupler of FIG. 6 for various coupling values;

DETAILED DESCRIPTION OF THE INVENTION

Figure 1A:
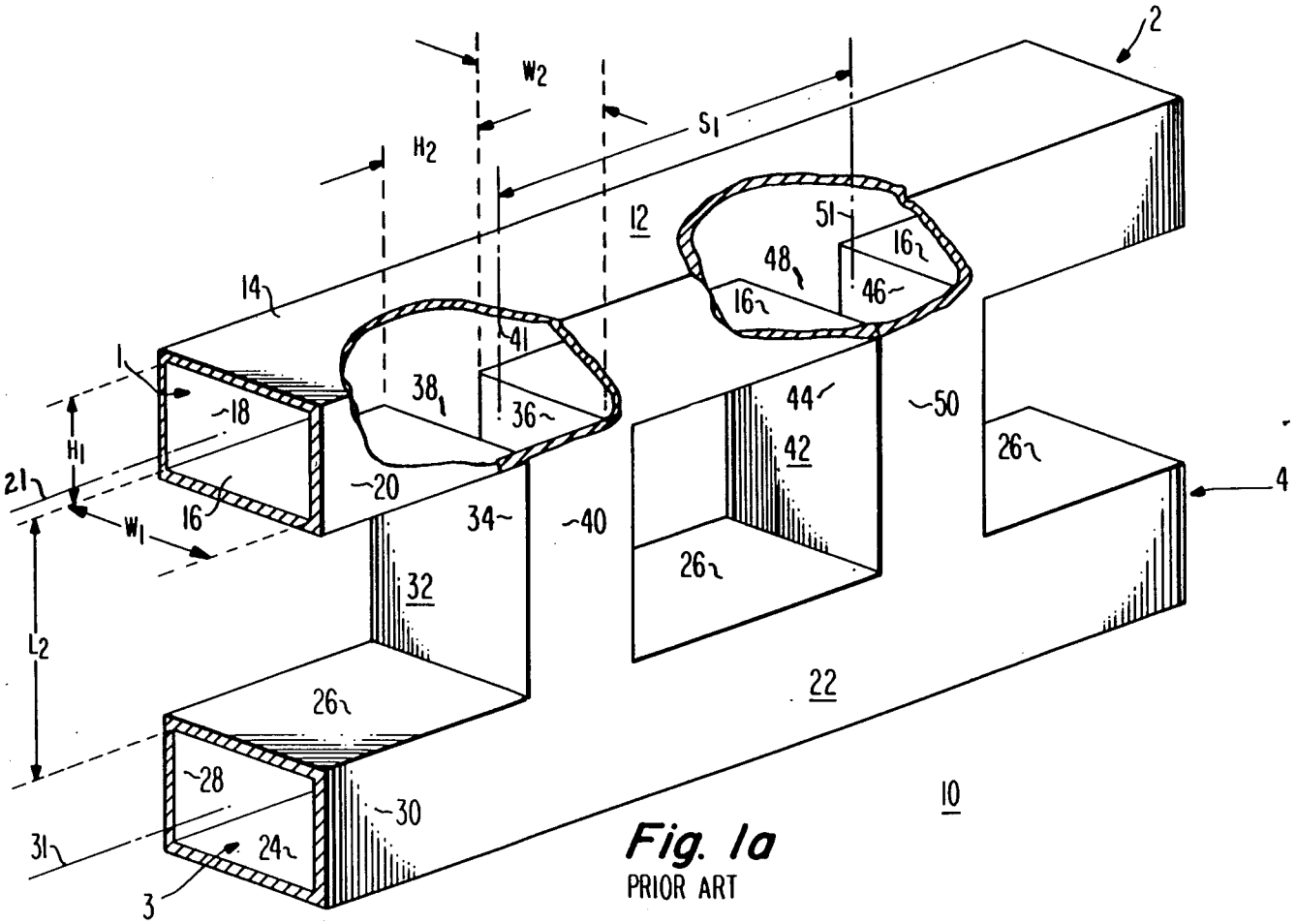
Fig. 1a PRIOR ART
FIG. 1*a* is a cut away isometric view of a prior art two-branch directional coupler fabricated from rectangular waveguide stock.

FIG. 1*a* illustrates a prior art two branch directional coupler designated generally as 10. Coupler 10 includes a first elongated section of through waveguide 12 having a rectangular cross-section defined by upper and lower broad conducting walls 14 and 16, respectively, which are joined together by narrow conductive walls 18 and 20. At one end of the illustrated portion of waveguide 12 is a port 1 and at the other end is a port 2. Elongated walls 14, 16, 18 and 20 together define a longitudinal waveguide axis 21 passing through the centers of ports 1 and 2.

Coupler 10 also includes a second through waveguide portion designated generally as 22 having a rectangular cross-section defined by broad conductive walls 24 and 26 spaced apart by narrow conductive walls 28 and 30. Waveguide portion 22 has ports 3 and 4. Elongated walls 24, 26, 28 and 30 together define a longitudinal axis 31 of waveguide 22 which passes through ports 3 and 4. Axes 21 and 31 are parallel, thereby establishing a mutually parallel orientation of waveguides 12 and 22. Broad walls 16 and 26 of waveguides 12 and 22 face each other.

The cross-section defined by broad walls 14 and 16 and narrow walls 18 and 20 has an interior width dimension $W_1$ equal to the width of broad walls 14 or 16. The interior dimension of through waveguide 12 parallel with a narrow wall 18 or 20 is termed the height and is designated by $H_1$.

Directional coupler 10 also includes a first branch waveguide designated generally as 32 and a second branch waveguide designated generally as 42. Branch waveguide 32 has a rectangular cross-section defined by a pair of broad walls 34 and 36 separated by narrow conductive walls 38 and 40. Walls 34, 36, 38 and 40 together define a central axis 41 of branch waveguide 32. Branch waveguide 32 intersects orthogonally and opens into through waveguides 12 and 22, so that branch waveguide longitudinal axis 41 intersects and is orthogonal to axes 21 and 31. The rectangular waveguide cross-section defined by walls 34, 36, 38 and 40 of branch waveguide 32 has a height illustrated by the dimension $H_2$ between the opposed faces of walls 34 and 36. The width of waveguide 32 is defined by the distance $W_2$ between the opposed faces of walls 38 and 40. As illustrated, width $W_2$ equals width $W_1$. Walls 34, 36, 38 and 40 are elongated so as to extend between broad wall 16 of waveguide 12 and broad wall 26 of waveguide 22. The length of waveguide 32 between walls 16 and 26 is illustrated as dimension $L_2$.

Branch waveguide 42 has a rectangular cross-section defined by a pair of broad walls 44 and 46 separated by narrow conductive walls 48 and 50. Walls 44, 46, 48 and 50 together define a central axis 51 of branch waveguide 42. Branch waveguide 42 orthogonally intersects and opens into through waveguides 12 and 22, so that branch waveguide longitudinal axis 51 intersects and is orthogonal to axes 21 and 31. The rectangular waveguide cross-section defined by walls 44, 46, 48 and 50 also has a height $H_2$ between the opposed faces of walls 44 and 46. The width of waveguide 42 defined by distance between the opposed faces of walls 48 and 50 is $W_2$ also equal to $W_1$, in conformance with the definition for branch waveguide 32. Walls 44, 46, 48 and 50 are elongated so as to extend between broad wall 16 of waveguide 12 and broad wall 26 of waveguide 22. The length of branch waveguide 42 between walls 16 and 26 is $L_2$, the same as the length of branch waveguide 32.

The separation between branch waveguide axes 41 and 51 is one-quarter waveguide wavelength ($\lambda/4$) at the center of the operating frequency range. This separation is indicated by dimension $S_1$. Dimension $L_2$ (the separation between the through waveguides) is also $\lambda/4$. With such dimensions, a portion of the energy entering directional coupler 10 through port 1 and propagating towards port 2 flows out of port 2, and another portion flows toward waveguide 22 through branch waveguides 32 and 42. As the signal exits from branch waveguides 32 and 42 into through waveguide 22, it divides, half flowing towards each of ports 3 and 4. That signal flowing towards port 3 from branch waveguide 32 is phase shifted by 180° relative to that portion flowing towards port 3 from branch waveguide 42, and therefore cancels, so that ideally no energy flows from port 3. That signal flowing towards port 4 from branch waveguide 32 adds in-phase to the portion from branch waveguide 42, so that substantially all the energy entering branch waveguides 32 and 42 from through waveguide 12 exits from port 4. Naturally, if the signal is applied to directional coupler 10 through port 2 rather than through port 1, that part not exiting from port 1 exits from port 3.

Figure 1B:
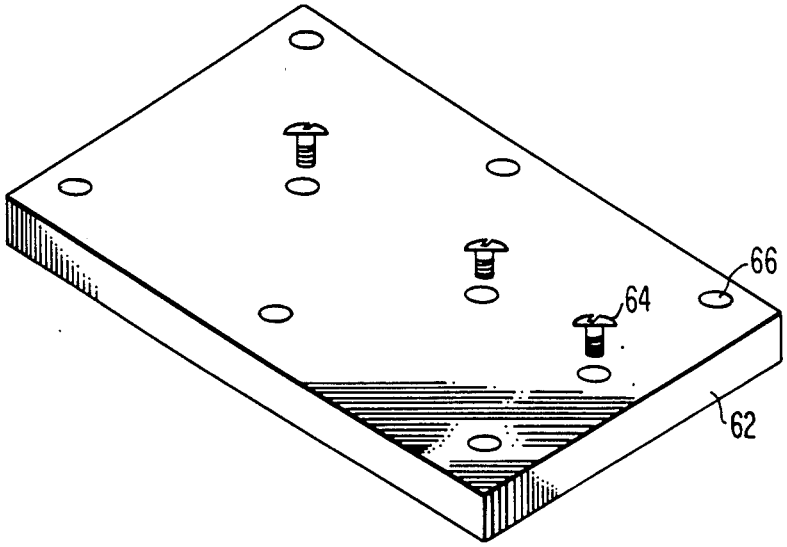
Fig. 1b PRIOR ART
FIG. 1*b* is an exploded isometric view of a corresponding directional coupler fabricated by machining from a single block of metal.
Figure 1B:
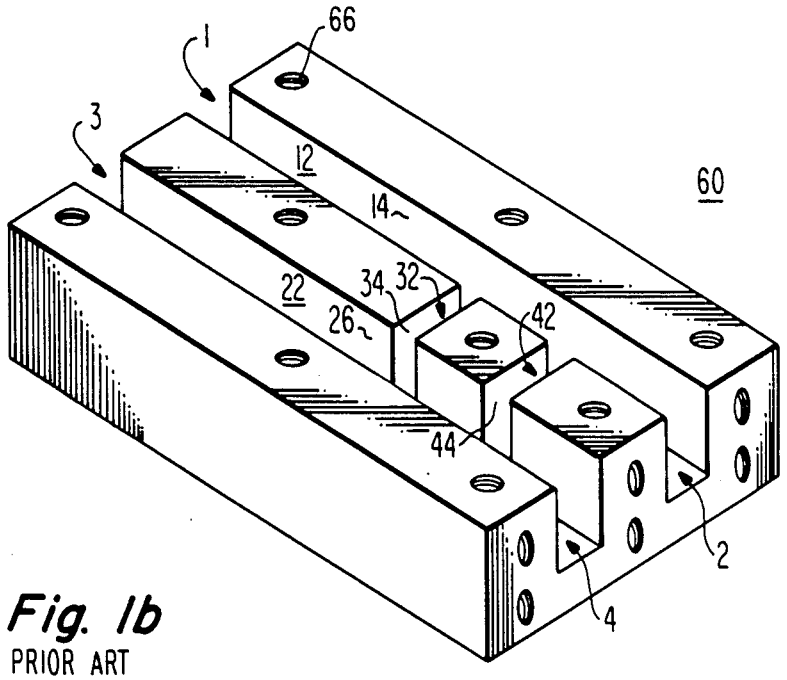
Fig. 1b PRIOR ART

Waveguide directional couplers are often not formed from sections of rectangular waveguides as illustrated in FIG. 1*a*. The through and branch waveguides may be machined into a conductive block, as illustrated in FIG. 1*b* in order to provide and maintain accuracy alignment. In FIG. 1*b*, elements corresponding to those of FIG. 1*a* are designated by the same reference number. In FIG. 1*b*, a conductive block or housing designated generally as 60 is machined with a series of slots which define through waveguides 12 and 22 and branch waveguides 32 and 42, and which also define through waveguide ports 1, 2, 3 and 4. The open side of block 60 is closed by a conductive cover 62, and the two are fastened together by a matching set of screws, some of which are illustrated as 64, and apertures, some of which are illustrated as 66. In a structure such as that of FIG. 1*b*, it will be readily understood that once it has been fabricated, reduction of the size of the slots defining branch waveguides 32 and 42 will not be possible without adding a machined piece of metal. Added-on pieces of metal are very disadvantageous, especially at higher frequencies, because the seams between the original piece and the added metal tend to introduce unwanted modes and/or excess losses. Similarly, any change in branch waveguide cross-sectional dimension which is not symmetrically disposed relative to an axis of a branch waveguide will disrupt the center-to-center spacing (dimension $S_1$ of FIG. 1*a*), thereby affecting the performance of the coupler.

Figure 2:
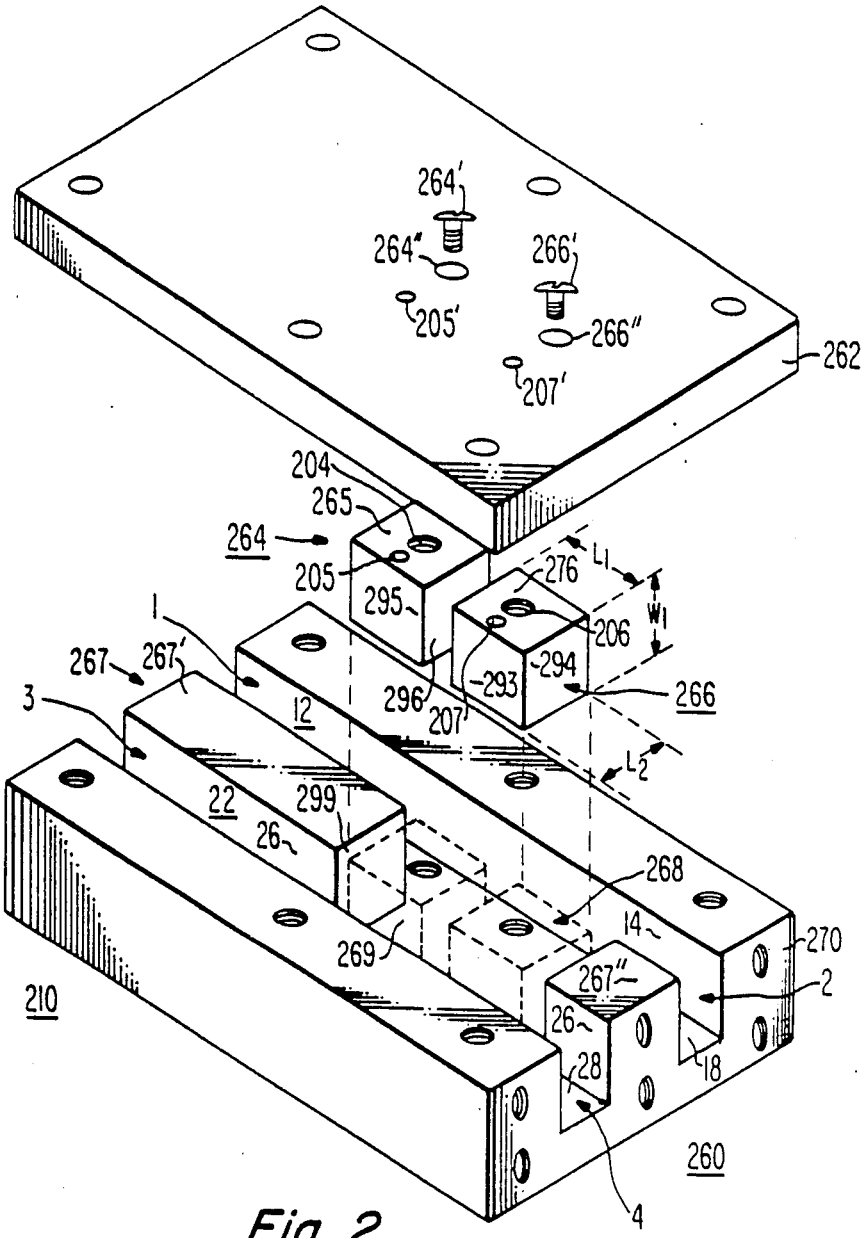
FIG. 2 is an exploded perspective view of a three-branch directional coupler according to the invention.

FIG. 2 illustrates a directional coupler 210 in accordance with the invention. Elements of FIG. 2 corresponding to those of FIGS. 1*a* and 1*b* are designated by the same reference numbers. In FIG. 2, the directional coupler includes a conductive housing designated generally as 260, a conductive cover designated 262, and two identical conducting blocks 264 and 266. Conductive housing 260 has rectangular slots milled therein to define a through waveguide 12 and its associated waveguide ports 1 and 2. Another slot defines a second through waveguide 22 having input ports 3 and 4. Waveguide ports 2 and 4 open through wall 270 of block 260. Waveguide 22 is parallel to waveguide 12, and together they define a septum 267 including portions 267' and 267''. Instead of a plurality of branch waveguides, a chamber 268 is formed in housing 260 by machining out a portion of septum 267 lying between septum portions 267' and 267''. The chamber is machined to a depth such that its bottom wall 269 is even with through waveguide walls 18 and 28. The wall of septum 267' facing chamber 268 is designated 299. A corresponding wall 298 (not visible in FIG. 2) of septum 267'' faces wall 299. As illustrated by dotted outlines, chamber 268 accommodates conductive blocks 264 and 266. Each block is in the form of a rectangular parallelepiped having dimensions $W_1$, $L_1$ and $L_2$. Dimension $W_1$ equals the width of through waveguides 12 and 22 (the height of septum 267 as illustrated in FIG. 2). When a conductive cover 262 is fastened over housing 260 with conductive blocks 264 and 266 in place, their top surfaces 265 and 276, respectively, are in contact with the facing portion of cover 262 (not visible in FIG. 2) while the bottom surfaces of the blocks (also not visible in FIG. 2) contact the bottom wall 269 of chamber 268 and are in the same plane as narrow through waveguide walls 18 and 28. Block 264 has side walls 295 and 296 visible, and block 266 has side walls 293 and 294 visible in FIG. 2. The $L_2$ dimensions of blocks 264 and 266 equal the width of septum 267 and thereby define the lengths of the branch waveguides formed when the blocks are in place. The $L_1$ dimensions of blocks 264 and 266 are such that when the blocks are in place, three branch waveguides are formed, as described in more detail below. Blocks 264 and 266 when assembled into housing 260 are held in position by screws 264' and 266' passing through clearance holes 264'' and 266'' and threaded into threaded holes 204 and 206 in the centers of sides 265 and 276, respectively. Blocks 264 and 266 are prevented from rotating from their preselected positions by keying pins 205' and 207' which are staked through apertures in cover 62 and protrude into matching apertures 205 and 207 in sides 265 and 267, respectively, which receive pins 205' and 207', respectively. Further fasteners may be used as required.

Figure 3A:
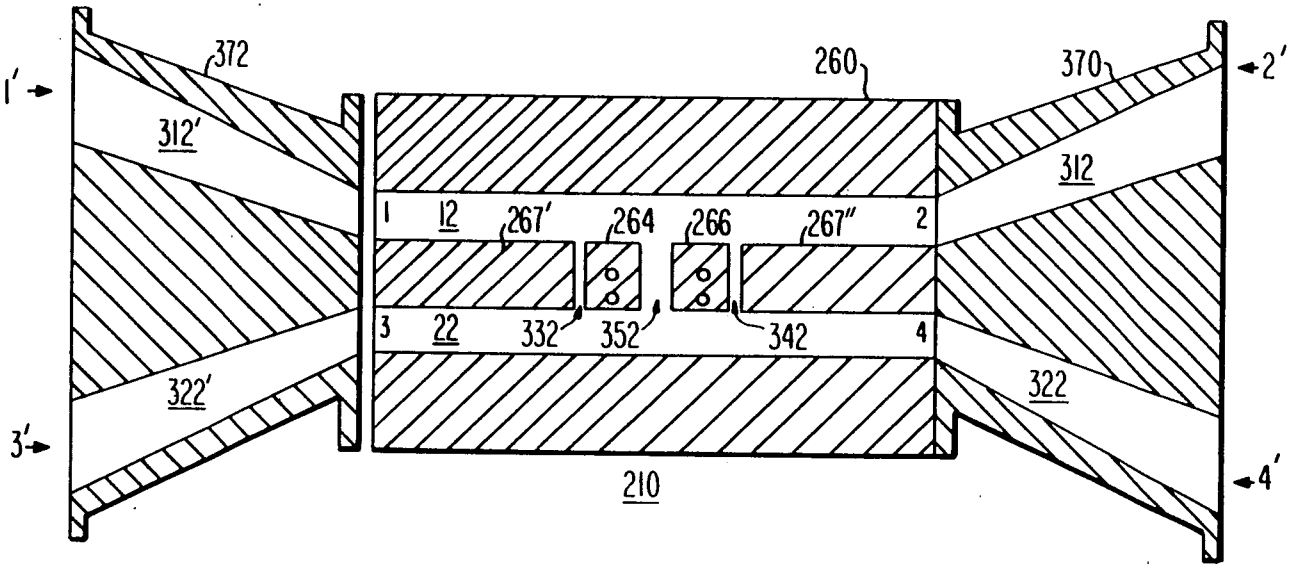
FIG. 3*a* is a cross-sectional view of the coupler of FIG. 2, together with tapered adaptors for coupling to its ports.

FIG. 3*a* is a cross-sectional view of directional coupler 210 of FIG. 2, together with tapered adaptors for the various ports. Elements of FIG. 3*a* corresponding to those of FIG. 2 are designated by the same reference numbers. Housing 260 in FIG. 3*a*, as mentioned, defines through waveguide ports 1, 2, 3, and 4. In many cases, the widths of septum portions 267' and 267'' will be such that separate waveguide flanges cannot be conveniently fastened to wall 270 for coupling to mutually adjacent waveguide ports such as ports 2 and 4. In order to provide means for convenient coupling to pairs of ports such as 1, 3 and 2, 4, adaptors such as 370 and 372 are provided which are formed with waveguide sections such as 312 and 322 which diverge so as to provide a set of ports 1', 3'; 2', 4' which are sufficiently separated to allow connection of separate standard waveguide flanges. A further purpose of adaptors such as 370, 372 is to adapt nonstandard through waveguide dimensions to standard waveguide dimensions, if necessary, for ready coupling of the directional coupler to the remainder of a system. As described below, the directional coupler may use through waveguides having cross sectional dimensions which have reduced height compared with standard waveguide, in order to increase the bandwidth of the coupler. As illustrated in FIG. 3*a*, adaptors 370 and 372 have waveguide cross-sections which increase with increasing distance from the ports 1, 2, 3, 4 of directional coupler 210.

Figure 3B:
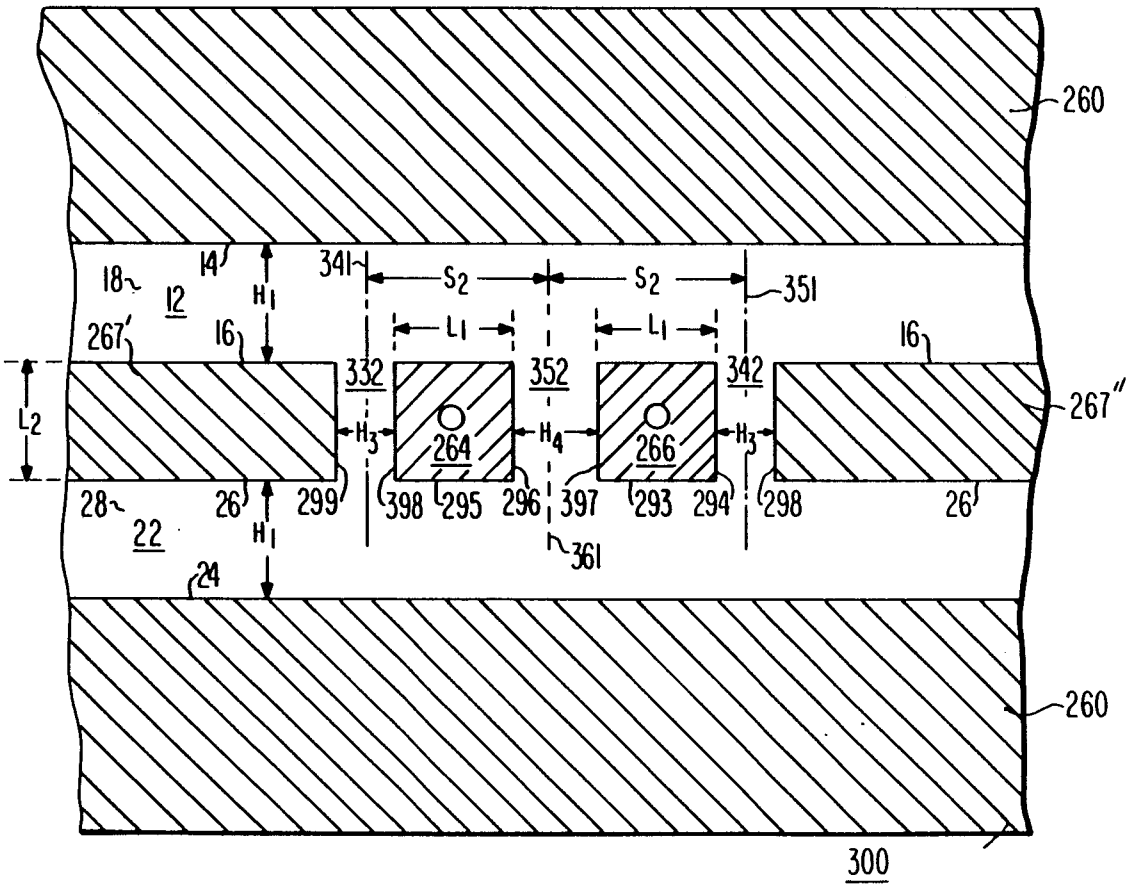
FIG. 3*b* is an expanded view of the center of the coupler of FIG. 3*a,* and FIG. 3*c* tabulates dimensions of portions of the coupler of FIG. 3*b;*

As illustrated in FIG. 3*a*, blocks 264 and 266 when fastened into place define three branch waveguides. A center branch waveguide 352 is centered between a pair of outer branch waveguides 332 and 342. FIG. 3*b* illustrates these branch waveguides in more detail. As illustrated in FIG. 3*b*, conductive blocks 264 and 266 are located between faces 298 and 299 of septum portions 267'' and 267', respectively. Branch waveguide 332 is defined by the region between wall 299 of septum portion 267' and a wall 398 of block 264. The separation therebetween is designated $H_3$. Similarly, second outer branch waveguide 342 is defined by the separation between wall 298 of septum portion 267'' and wall 294 of conductive block 266. The separation therebetween defines the height of branch waveguide 342 and is identified as $H_3$, the same dimension as the height of outer branch waveguide 332.

The separation between blocks 264 and 266 defines a further central branch waveguide 352 having a height $H_4$ between walls 296 and 397 of block 264 and 266, respectively. Outer branch waveguides 332 and 342 have mutually parallel longitudinal axes 341 and 351, respectively, and central branch waveguide 352 has a longitudinal axis 361 which is parallel to axes 341 and 351. The center-to-center spacing between branch waveguides is the separation between axes 341 and 361, and between axes 361 and 351. These distances are equal, and are identified as $S_2$. A family of directional couplers as illustrated in FIGS. 2, 3*a*, and 3*b* designed for the operating frequency range of 11.7 to 12.2 GHz has a center frequency of 11.95 GHz. The wavelength in air at the center frequency is 0.988 inches (25.09 mm), and $\lambda/4=0.247$ in. (6.27 mm). The through waveguides of this directional coupler have dimensions equivalent to half height WR75 waveguide. In WR 75 waveguide, the wavelength at the center frequency is 1.312 inches (33.4 mm), and $\lambda/4=0.328$ inches (8.30 mm). The through waveguide height $H_1$ is 0.200 in. (5.08 mm), and the $W_1$ dimension is 0.750 in. (19.05 mm). Dimension $W_1$ (FIG. 1*a*) defines the width of the branch waveguides 332, 342 and 352 as 0.750 inches. The dimensions of chamber 268 occupied by blocks 264 and 266 are defined by the width of septum 267', 267'', which equals 0.2769 in. (7.03 mm), thereby defining the lengths of branch waveguides 332, 342 and 352 as 0.2769 in. between through waveguide walls 16 and 26. At the center frequency of the design operating frequency range, the length of the branch waveguides equals 0.211 $\lambda$. The separation between walls 298 and 299 of chamber 268 is 0.6838 in. (17.36 mm). FIG. 3*c* tabulates the heights of branch waveguides 332, 342 and 352, the $L_1$ dimensions of blocks 264 and 266, and the center-to-center spacing $S_2$ of the branch waveguides, for various coupling factors ranging from −6.00 dB to −13.01 dB. For coupling values in the range of −0.5 to −8 dB, a four branch coupler appears to provider broader bandwidth than a three-branch coupler. Coupling values greater than −8 dB (for example, −10 dB) require tight tolerances in the dimensions of the branch waveguides as the number of branches increases, and three branch couplers may be more satisfactory. It will be noted from column V of FIG. 3*c* that for all coupling factors the overall length of the coupler (the dimension between walls 298 and 299 of chamber 268) is constant and is equivalent to 0.52 waveguide wavelengths at the center of the operating frequency range. From the wavelength ($\lambda$) portion of column IV of FIG. 3*c* it can be seen that the center-to-center spacing between branch waveguides ranges from 0.239 to 0.251 waveguide wavelengths.

Figure 4:
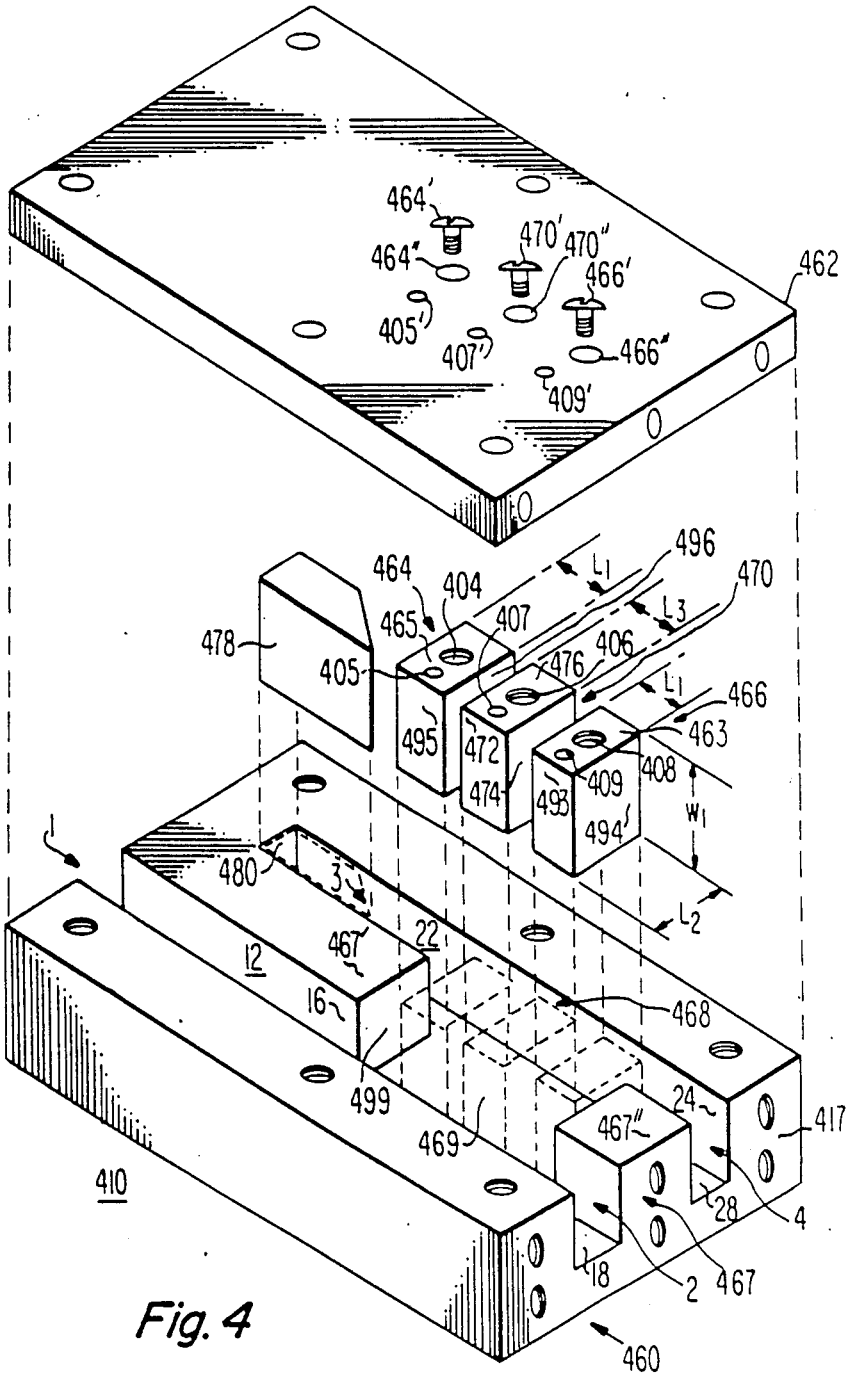
FIG. 4 is an exploded perspective view of a four-branch directional coupler according to the invention which has an internal waveguide load.

FIG. 4 illustrates a directional coupler 410 in accordance with the invention. Elements of FIG. 4 corresponding to those of FIGS. 2 and 3 are designated by the same reference numbers. In FIG. 4, directional coupler 410 includes a conductive housing designated generally as 460, a conductive cover designated 462, and three identical conducting blocks 464, 466 and 470. Conductive housing 460 has rectangular slots milled therein to define a through waveguide 12 and its associated waveguide ports 1 and 2. Another slot defines a second through waveguide 22 having an input port 4. The milled portion of slot 22 corresponding to port 3 ends at a conductive wall 480, while ports 2 and 4 exit through-face 417 of block 460. A wedge-shaped block 478 of energy absorbing material is located within through waveguide 22 to absorb any energy which propagates toward port 3. Waveguide 22 is parallel to waveguide 12, and together they define a septum 467 including portions 467' and 467''. A chamber 468 is formed in housing 460 by machining out a portion of septum 467 lying between septum portions 467' and 467''. Chamber 468 is machined to a depth such that its bottom wall 469 is even with through waveguide narrow walls 18 and 28. The wall of septum 467' facing chamber 468 is designated 499. A corresponding wall 498 (not visible in FIG. 4) of septum portion 467'' faces wall 499. As illustrated by phantom outlines, chamber 468 accommodates conductive blocks 464, 466 and 470. Blocks 464 and 466 are in the form of rectangular parallelepipeds having dimensions $W_1$, $L_1$ and $L_2$. Center block 470 is also in the form of rectangular parallelepiped having dimensions $W_1$, $L_3$ and $L_2$. Dimension $W_1$ equals the width dimension (the larger cross-sectional dimension) of through waveguides 12 and 22, which is the height of septum 467 as illustrated in FIG. 4. When a conductive cover 462 is fastened over the open side of housing 460 with conductive blocks 464, 466 and 470 in place, their top surfaces 465, 463 and 476, respectively, are in contact with the facing portion of cover 462 (not visible in FIG. 2) while the bottom surfaces of the blocks (also not visible in FIG. 4) contact the bottom wall 469 of chamber 468 and lie in the same plane as narrow through waveguide walls 18 and 28. Also visible in FIG. 4 are surfaces 495 and 496 of block 464, surfaces 493 and 494 of block 466, and surfaces 472 and 474 of block 470. The $L_2$ dimensions of blocks 464, 466, and 470 equal the width of septum 467 and thereby define the lengths of the branch waveguides formed when the blocks are in place. The $L_1$ dimensions of blocks 464 and 466 and the $L_3$ dimension of block 470 are such that when the blocks are in place, four branch waveguides are formed, as described in more detail below. Blocks 464, 466 and 470 when assembled into housing 460 are held in position by screws 464', 466' and 470', respectively, passing through clearance holes 464'', 466'' and 470'', respectively and threaded into threaded holes 404, 408 and 406, respectively. The blocks are prevented from rotating from their preselected positions by keying pins 405', 407' and 409' staked into holes in cover 462 and protruding into corresponding apertures 405, 407 and 409 in blocks 464, 470 and 466, respectively. Further fasteners and keying pins may be used if desired.

Figure 5:
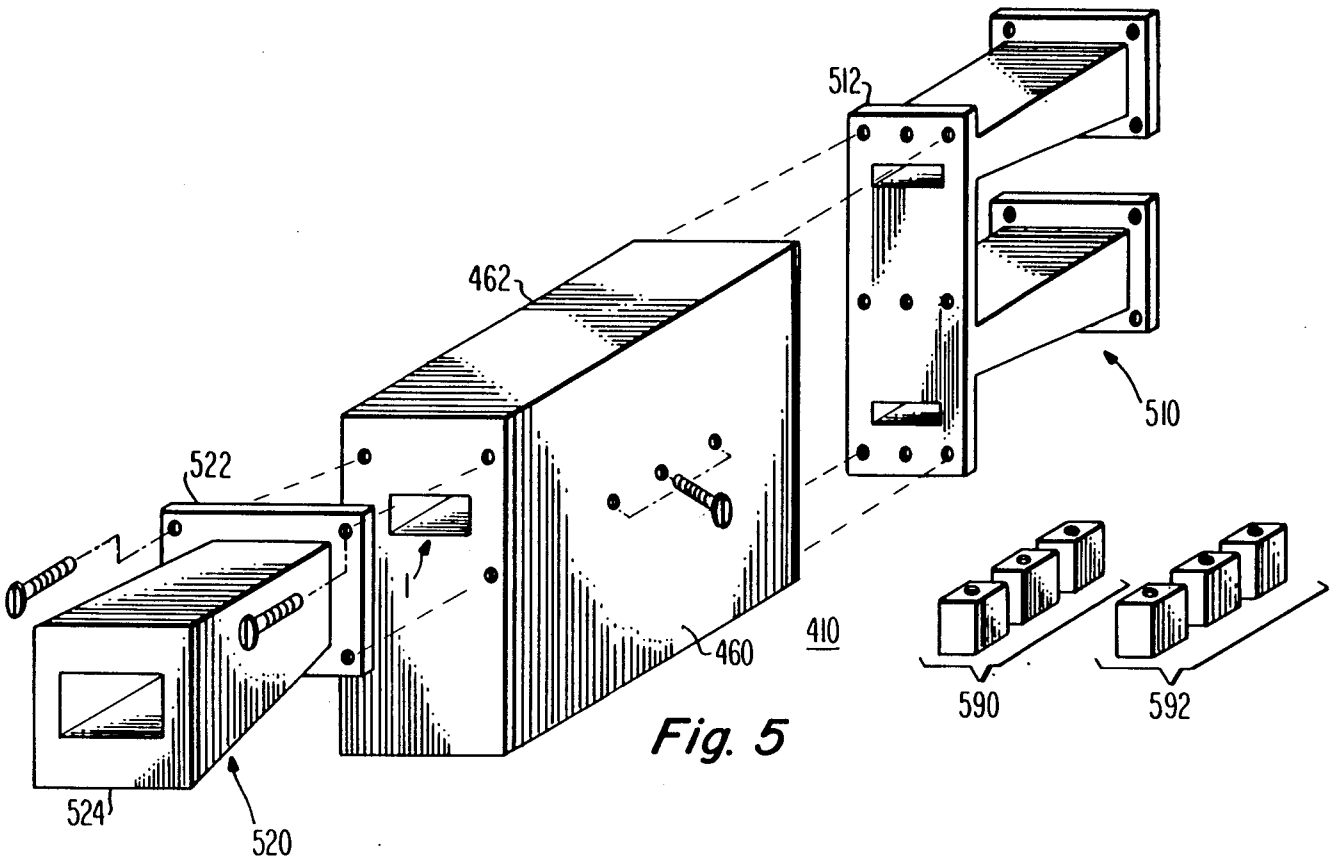
FIG. 5 is an exploded perspective view of the coupler of FIG. 4 together with tapered adaptors for coupling to its externally accessible ports.

FIG. 5 is a perspective view of directional coupler 410 in its assembled form together with tapered adapters for coupling to its ports and including two sets of blocks. In FIG. 5, a pair of tapered adapters 510 include a common flange 512 adapted for coupling to exterior face 467 of housing 410 (FIG. 4). At the near side of directional coupler 410 as viewed in FIG. 5, only a single port (port 1) is available for coupling, since port 3 is internally terminated. A further tapered adapter 520 includes a tapered waveguide section 524 for adapting the through waveguide cross-sectional dimensions to standard waveguide cross sectional dimensions. Tapered adapter 520 also includes a flange 522 for coupling to housing 460 and cover 462. A set 590 of three conductive blocks is dimensioned to coact with the cavity of housing 460 to define a branch coupler having a first coupling value, and a second set of blocks 592 is used instead of blocks 590 to define a second coupling value.

Figure 6A:
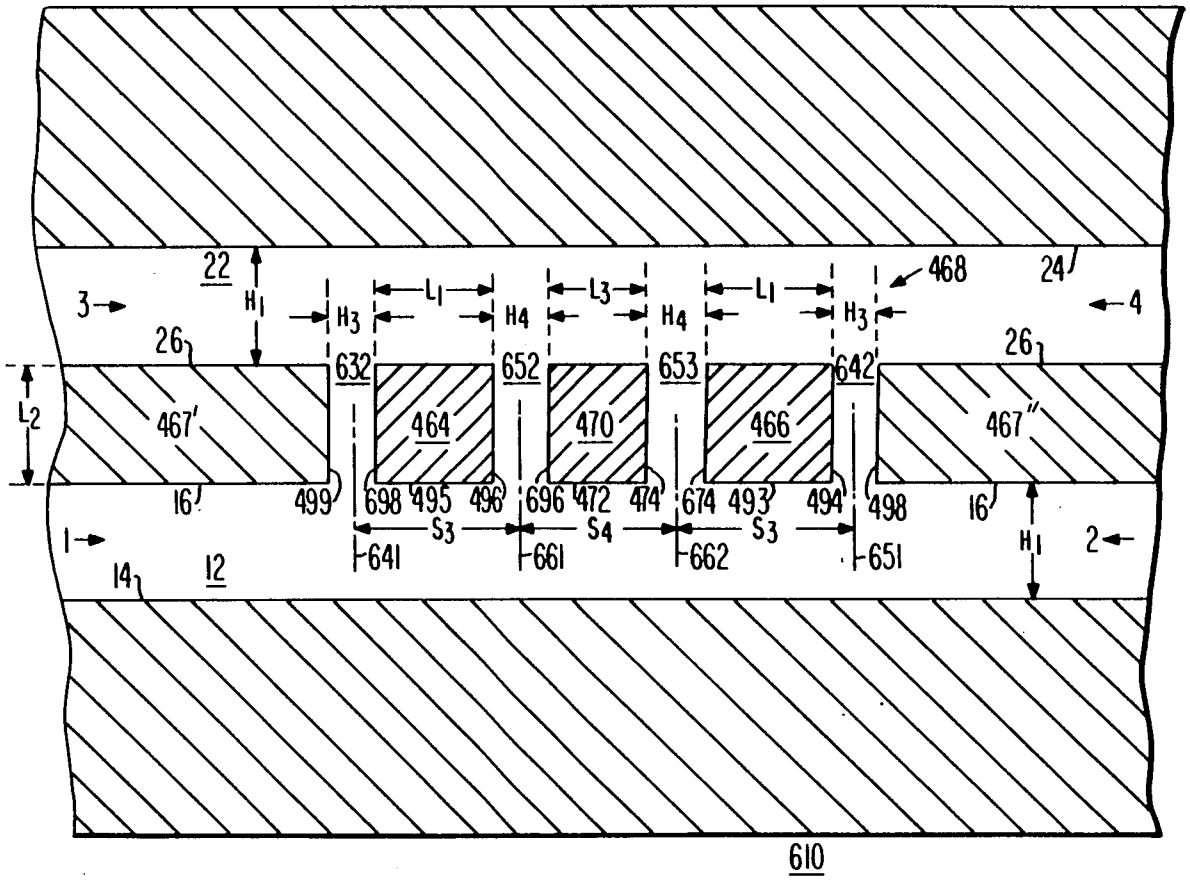
FIG. 6*a* is a cross-sectional view of a four-branch coupler similar to that of FIG. 4.

FIG. 6*a* is a cross-sectional view of a three block, four branch coupler 610 similar to coupler 410 of FIG. 4 but having four externally accessible ports. Elements of FIG. 6*a* corresponding to those of FIG. 4 are designated by the same reference numeral. As illustrated in FIG. 6*a*, blocks 464, 466 and 470 when fastened into place define four branch waveguides. Conductive blocks 464 and 466 are located adjacent to walls 499 and 498, respectively, of septum portions 467' and 467'', respectively. An outer branch waveguide 632 is defined by the region between wall 499 of septum portion 467' and a wall 698 of block 464. The separation therebetween is designated $H_3$ and corresponds to the height of the branch waveguide 632. Similarly, a second outer branch waveguide 642 is defined by the separation between wall 498 of septum portion 467'' and wall 494 of conductive block 466. The separation therebetween defines the height of branch waveguide 642 and is identified as $H_3$, the same dimension as the height of outer branch waveguide 632.

Conductive block 470 lies between blocks 464 and 466. The separation between wall 496 of conductive block 464 and a wall 696 of conductive block 470 defines a main branch waveguide 652 having a height $H_4$ between walls 496 and 476. The separation between wall 474 of conductive block 470 and a wall 674 of conductive block 466 defines a second main branch waveguide 653 also having a height $H_4$ between walls 474 and 674. Outer branch waveguides 632 and 642 have mutually parallel longitudinal axes 641 and 651, respectively, and main branch waveguides 652 and 653 have longitudinal axes 661 and 662, respectively. The center-to-center spacing between an outer branch waveguide and the adjacent main branch waveguide is the separation between axes 641 and 661, or between axes 651 and 662. These distances are equal, and are identified as $S_3$. The separation between adjacent main branch waveguides is the separation between axes 661 and 662, and is identified as $S_4$. Dimension $S_4$ may be made equal to $S_3$. A family of directional couplers as illustrated in FIG. 6*a* for the operating frequency range of 11.7 to 12.2 GHz has a center frequency of 11.95 GHz. The wavelength ($\lambda$) at the center frequency is 0.988 in. (25.09 mm) in air, and $\lambda/4$ in air equals 0.247 in. (6.27 mm). The through waveguides of this directional coupler have dimensions equivalent to half height WR75 waveguide. The wavelength at the center frequency in the waveguide is 1.312 inches (33.4 mm). The through waveguide height $H_1$ is 0.200 in. (5.08 mm), and the $W_1$ dimension is 0.750 in. (19.05 mm). Dimension $W_1$, as mentioned, defines the width of the branch waveguides 632, 642, 652, 653 in a direction perpendicular to the view of FIG. 6*a* as 0.750 in. The width dimension of chamber 468 occupied by blocks 464, 466 and 470 is defined by the width of septum portions 467' and 467'', which equals 0.278 in. (7.06 mm), thereby defining the lengths of branch waveguides 632, 642, 652 and 653 as 0.28 in. between through waveguide walls 16 and 26. At the center frequency of the operating frequency range, the length of each of the branch waveguides equals 0.211 $\lambda$, and this does not change with the coupling value. The separation between walls 498 and 499 of chamber 468 is 1.0445 in. (26.53 ). FIG. 6*b* tabulates the heights $H_3$ of branch waveguides 632, 642, the heights $H_4$ of branch waveguides 652 and 653, the $L_1$ dimensions of blocks 464 and 466, the $L_3$ dimension of block 470, and the center-to-center spacings $S_3$ and $S_4$ of the branch waveguides for various coupling factors ranging from −1.01 to −10.03 dB. From column VII of FIG. 6*b*, the total chamber length is approximately 1.0445 in. (26.53 mm). Slight discrepancies in the calculated values in column VII are the result of rounding errors. The total chamber length corresponds to 0.80 waveguide wavelengths at the center of the operating frequency range. The $L_1$ dimensions of blocks 464 and 466 are indicated in column IV, and the $L_3$ dimension of block 470 is tabulated in column V. Branch heights $H_3$ and $H_4$ are tabulated in columns II and III, and the resulting branch spacing is tabulated in column VI. As indicated in the heading of column VI, spacing $S_3$ equals spacing S4.

Figure 7A:
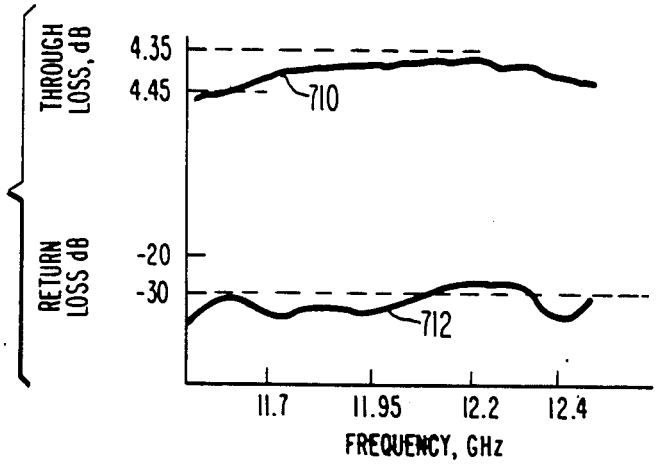
FIG. 7*a* and 7*b* are plots of attenuation versus frequency, illustrating through loss, coupling loss and return loss of a 2 dB coupler using dimensions from FIG. 6*b;*
Figure 7B:
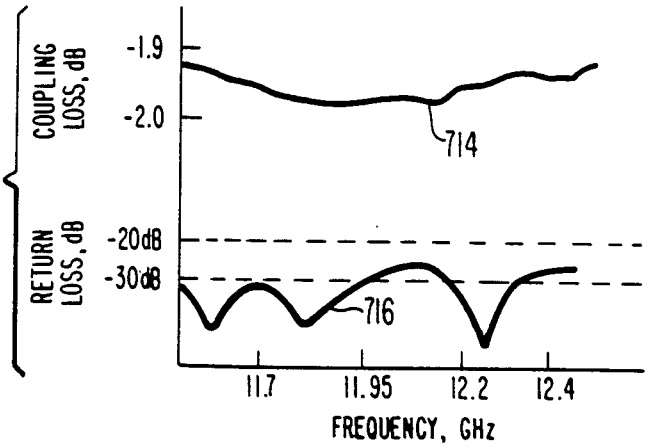

FIGS. 7*a* and 7*b* illustrate as a function of frequency the measured characteristics of a 2 dB four branch coupler similar to that illustrated in FIG. 6*a* having dimensions as stated for a −2.00 dB coupling factor in FIG. 6*b*. The illustrated frequency range is centered on 11.95 GHz. In FIG. 7*a*, the attenuation between ports 1 and 2 (the through waveguide attenuation) with ports 3 and 4 terminated appears as a plot 710, and the corresponding reflection loss at port 1 while measuring port 1 to port 2 attenuation is illustrated as a plot 712. As illustrated, the through attenuation ranges from 4.36 to 4.46 dB, slightly in excess of the calculated attenuation of 4.33 dB attributable to power division alone. The return loss illustrated by plot 712 is in excess of 20 dB at all frequencies within the frequency range 11.7–12.4 GHz, and is better than −30 dB at most frequencies in the band. Return loss is a measure of impedance match, and values of loss greater than about 25 dB are generally satisfactory. FIG. 7*b* illustrates as a plot 714 the attenuation measured from port 1 to coupled port 4 with ports 2 and 4 terminated. As expected, the 2.0 dB coupler has an attenuation close to 2.0 dB over the frequency range. It should be noted that the through and coupling losses illustrated in FIGS. 7*a* and 7*b*, and also in FIGS. 8*a*, 8*b*, 9*a* and 9*b*, have been corrected for the through losses of tapered adaptors used to make the tests. Plot 716 of FIG. 7*b* is a plot of return loss in port 1 under the slightly different measurement conditions required for making plot 714. The differences between plots 712 and 716 are believed to be due to slight differences in the impedances of the terminations used in the test set-up.

Figure 8A:
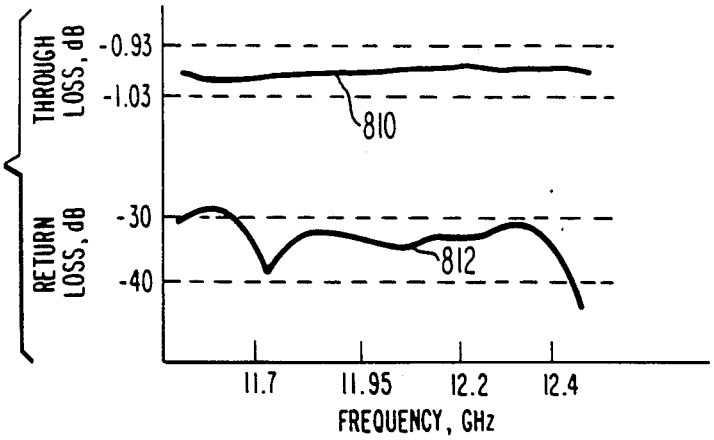
FIGS. 8*a* and 8*b* are plots of attenuation versus frequency, illustrating through loss, coupling loss and return loss of a 7 dB coupler using dimensions from FIG. 6*b.
Figure 8B:
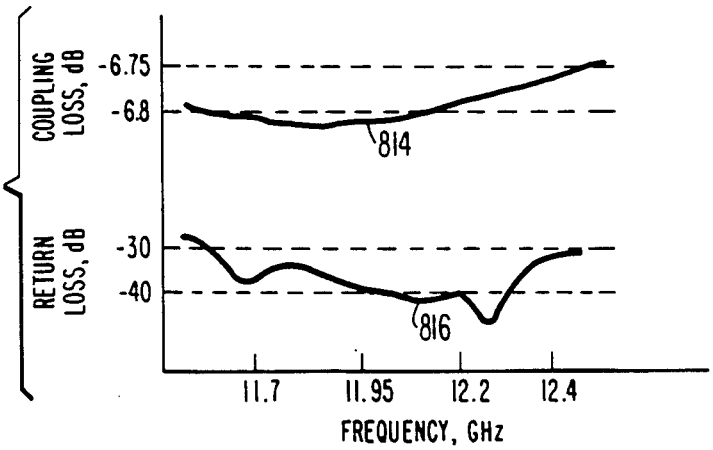

FIG. 8 illustrates the measured results of tests made on a directional coupler similar to that illustrated in FIG. 6*a* and using the same housing used to make the directional coupler from which the plots of FIGS. 7*a* and 7*b* were made, but with the blocks selected to produce 7.0 dB coupling. As illustrated by plot 810 of FIG. 8*a*, the through loss from port 1 to port 2 with the remaining ports terminated is in the range between 1.01 dB and 1.03 dB, slightly in excess of the calculated value of 0.96 dB. The reflection loss at port 1 for this measurement condition is illustrated as 812. The attenuation between ports 1 and 4 with ports 2 and 3 terminated is illustrated as plot 814 of FIG. 8*b*. As expected, the attenuation through this path is approximately 7.0 dB. For the measurement conditions required to establish plot 814, the reflection loss is illustrated as 816 of FIG. 8*b*. As illustrated in FIGS. 8*a* and 8*b*, the reflection loss at port 1 is in excess of 30 dB over substantially the entire frequency range. By symmetry, the other ports are expected to have similarly satisfactory return loss.

Figure 9A:
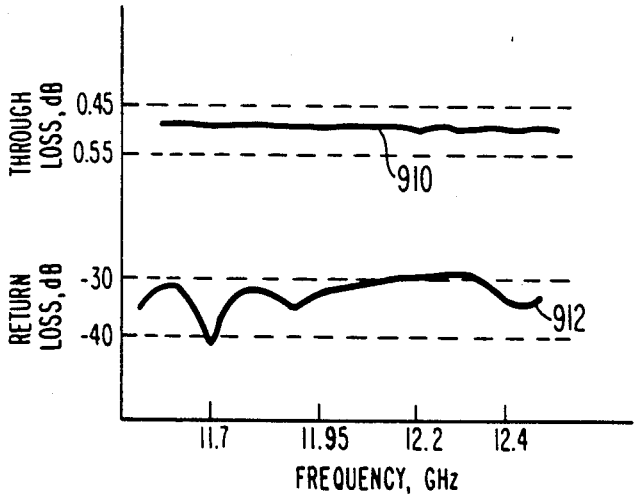
* and FIGS. 9*a* and 9*b* are plots of attenuation versus frequency, illustrating through loss, coupling loss and return loss of a 10 dB coupler using dimensions from FIG. 6*b.*
Figure 9B:
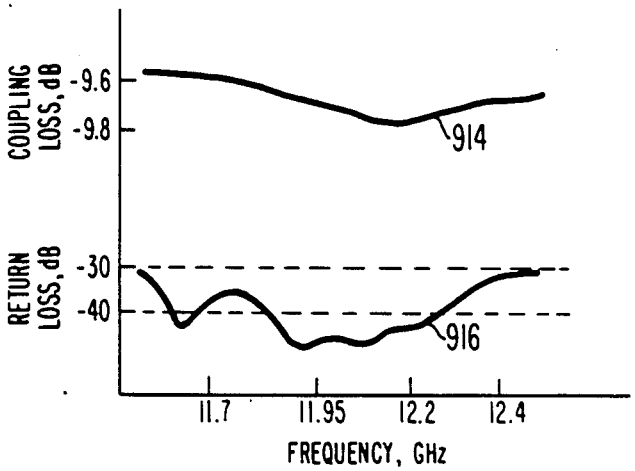

FIG. 9*a* illustrates the results of measurements made on a −10 dB coupler similar to that illustrated in FIG. 6*a* and again using the same housing, but with blocks selected to have dimensions as tabulated for a −10.03 dB coupler in FIG. 6*a*. The loss between ports 1 and 2 is illustrated as plot 910 of FIG. 9*a*, and the loss between ports 1 and 4 is illustrated as 914 of FIG. 9*b*. As illustrated by plots 912 and 916 of FIGS. 9*a* and 9*b*, respectively, the return loss exceeds −30 dB over substantially the entire operating frequency range.

Other embodiments of the invention will be apparent to those skilled in the art. For example, weight may be reduced by skeletonizing the metal housing, or the conductive surfaces may be formed by plating a thin layer of conductor over formed lightweight plastic material. Rather than being milled from a solid block, the coupler parts may be formed by electrodeposition. When the coupler is used in a mode requiring a matched termination at one port, an external load may be used rather than an internal termination as illustrated. A two-branch coupler may use a housing defining through waveguides, a chamber and a single block, if desired. Instead of tapered adapters, stepped-transformer adapters could be used in arrangements such that of FIG. 5. Naturally if the system in which the directional coupler is applied uses waveguide the dimensions of which match the dimensions of the through waveguide of the directional coupler, no adaptation of waveguide size is necessary. A watertight or electrical seal may be used in conjunction with the junction of the cover and housing, or the junctions of the waveguide flanges and the housing, to reduce leakage through the joints in known fashion.

What is claimed is:

1. A branch directional coupler having a coupling factor, which directional coupler is a member of a family of branch directional coupler each member of which has a different coupling factor, and each of which comprises:

a conductive housing defining the walls of first and second elongated mutually parallel waveguides defining parallel axes extending in the direction of the lengths of said first and second waveguides, and a chamber extending therebetween, each of said first and second waveguides having cross section in the form of a rectangle having width and height, said cross sections of said first and second waveguides having the same width, said chamber having a width equal to the width of said cross sections of said first and second waveguides, said chamber including first and second walls which are perpendicular to the walls of said first and second waveguides, the length of said chamber in a direction parallel to said axes being a predetermined value, the dimensions of said conductive housing being common to all members of said family;

at least one separate conductive block in the form of retangular parallelepiped fastended within said chamber by removable screws, said conductive block having lateral dimensions equal to said width of said first and second waveguides, a height dimension equal to the separation between the nearest walls of said first and second waveguides, respectively, and a length dimension selected to coact with said length of said chamber to define at least two branch waveguides extending between said first and second waveguides, respectively, to provide said coupling factor.

2. A waveguide branch directional coupler arangement having coupling value selectable amoung a plurality of values, comprising:

a conductive housing defining the walls of first and second eleongated mutually parallel waveguides defining parallel axes, and a chamber extending between said first and second waveguides, each of said first and second waveguides having a cross section in the form of a rectangle having a width and a height, said cross sections of said first and second waveguides having the same width, said chamber having a width equal to said width of said cross sections of said first and second waveguides, said chamber including first and second walls which are perpendicular to the walls of said first and second waveguides, the length of said chamber in a direction parallel to said axes being fixed;

at least two separate sets of conductive blocks, each said set including at least one conductive block, all blocks of each said set being in the form of rectangular parallelelepipeds, each said set of conductive blocks including fastening means for fastening the blocks of that set at predetermined positions within said chamber to define at least two branch waveguides extending orthogonally between said first and second waveguides to define one coupling value of said plurality of coupling values, whereby one said set of conductive blocks is used at any one time within said conductive housing to define a coupling value, and the remainder of said sets of conductive blocks are not used within said housing at said time but another set can be substituted for said one set to define another coupling value.

* * * * *

UNITED STATES PATENT AND TRADEMARK OFFICE
CERTIFICATE OF CORRECTION

PATENT NO. : 4,679,011

DATED : July 7, 1987

INVENTOR(S) : Krishna Praba and Charles E. Profera

It is certified that error appears in the above-identified patent and that said Letters Patent is hereby corrected as shown below:

Column 10, line 39, "coupler" should be --couplers--.

Column 10, line 63, delete "a" before --height--.

Column 10, line 66, delete "a" before --length--.

Column 11, line 4, "amoung" should be --among--.

Signed and Sealed this

First Day of March, 1988

*Attest:*

DONALD J. QUIGG

*Attesting Officer*

*Commissioner of Patents and Trademarks*